US009085451B2

(12) United States Patent
Santy

(10) Patent No.: US 9,085,451 B2
(45) Date of Patent: Jul. 21, 2015

(54) MULTI-FLAVOR MECHANICAL DISPENSING VALVE FOR A SINGLE FLAVOR MULTI-HEAD BEVERAGE DISPENSER

(71) Applicant: Schroeder Industries, Inc., San Antonio, TX (US)

(72) Inventor: David Santy, Converse, TX (US)

(73) Assignee: Schroeder Industries, Inc., San Antonio, TX (US)

( * ) Notice: Subject to any disclaimer, the term of this patent is extended or adjusted under 35 U.S.C. 154(b) by 62 days.

(21) Appl. No.: 13/836,171

(22) Filed: Mar. 15, 2013

(65) Prior Publication Data

US 2014/0034675 A1 Feb. 6, 2014

Related U.S. Application Data

(60) Provisional application No. 61/678,253, filed on Aug. 1, 2012.

(51) Int. Cl.
*B67D 7/06* (2010.01)
*B67D 1/00* (2006.01)

(52) U.S. Cl.
CPC ..... *B67D 1/0036* (2013.01); *B67D 1/0029* (2013.01); *B67D 1/0037* (2013.01); *B67D 1/0083* (2013.01); *B67D 2210/00034* (2013.01)

(58) Field of Classification Search
CPC .. B67D 1/0029; B67D 1/0036; B67D 1/0037; B67D 1/0083; B67D 1/0021; B67D 1/0034; B67D 1/0044; B67D 1/0081; B67D 1/0082
USPC ..... 222/129.1, 132, 144.5, 145.1, 145.5, 222/145.6
See application file for complete search history.

(56) References Cited

U.S. PATENT DOCUMENTS

| | | | | | |
|---|---|---|---|---|---|
| 1,413,755 | A | * | 4/1922 | Messman | 137/241 |
| 1,603,082 | A | * | 10/1926 | Jacobs | 137/607 |
| 2,558,700 | A | * | 6/1951 | Burgess | 137/636.1 |
| 3,503,540 | A | * | 3/1970 | Fuerst | 222/129.1 |
| 3,892,335 | A | * | 7/1975 | Schroeder | 222/129.1 |
| 4,370,950 | A | * | 2/1983 | Furukubo | 123/41.08 |
| 4,433,795 | A | * | 2/1984 | Maiefski et al. | 222/14 |
| 4,497,421 | A | * | 2/1985 | Schilling | 222/144.5 |
| 4,619,378 | A | * | 10/1986 | de Man | 222/144.5 |
| 4,741,355 | A | * | 5/1988 | Credle et al. | 137/269 |
| 4,821,925 | A | * | 4/1989 | Wiley et al. | 222/129.4 |
| 4,921,140 | A | * | 5/1990 | Belcham | 222/144.5 |
| D309,232 | S | * | 7/1990 | Valiyee et al. | D7/398 |
| 4,986,449 | A | * | 1/1991 | Valiyee et al. | 222/144.5 |

(Continued)

*Primary Examiner* — Paul R Durand
*Assistant Examiner* — Randall Gruby
(74) *Attorney, Agent, or Firm* — Jackson Walker, LLP

(57) ABSTRACT

For retrofitting to a backblock of an existing multi-head, multi-backblock beverage dispensing machine, Applicant provides a valve having, in one embodiment, walls adapted to fluidly engage a backblock. A primary circuit has a pair of primary circuit pathways adapted to receive pressurized syrup and pressurized water from the backblock. The valve provides a multiplicity of supplemental circuit pathways adapted to receive (typically not from a backblock) a multiplicity of different syrups from a multiplicity of different pressurized syrup sources. Flow control elements in the valve engage the circuits to control the rate of flow of fluid therethrough. Operator pushbutton controlled valved chambers open and close the circuit pathways. A post-mix valve assembly mixes a syrup from a circuit pathway with the pressurized water from the primary circuit.

8 Claims, 17 Drawing Sheets

(56) References Cited

U.S. PATENT DOCUMENTS

| | | | | |
|---|---|---|---|---|
| 5,042,692 | A * | 8/1991 | Valiyee et al. | 222/144.5 |
| 5,102,011 | A * | 4/1992 | Whigham et al. | 222/1 |
| 5,285,815 | A * | 2/1994 | Henry et al. | 137/595 |
| 5,685,458 | A * | 11/1997 | Durham et al. | 222/129.1 |
| 5,868,279 | A * | 2/1999 | Powell | 222/59 |
| 5,884,813 | A * | 3/1999 | Bordonaro et al. | 222/129.1 |
| 5,954,235 | A * | 9/1999 | Schroeder et al. | 222/129.1 |
| 6,192,935 | B1 * | 2/2001 | Schroeder et al. | 137/625.41 |
| 6,286,721 | B1 * | 9/2001 | Pellegrini | 222/129.1 |
| 6,439,428 | B1 * | 8/2002 | Schroeder et al. | 222/64 |
| 6,443,335 | B1 * | 9/2002 | Pinedjian et al. | 222/504 |
| 6,547,100 | B2 * | 4/2003 | Phillips et al. | 222/129.1 |
| 7,290,680 | B2 * | 11/2007 | Henry et al. | 222/129.1 |
| 7,305,847 | B2 * | 12/2007 | Wolski et al. | 62/390 |
| 7,669,737 | B2 * | 3/2010 | Bethuy et al. | 222/129.1 |
| 8,272,536 | B2 * | 9/2012 | Valiyee et al. | 222/144.5 |
| 8,418,888 | B2 * | 4/2013 | Schroeder et al. | 222/145.5 |
| 2001/0011660 | A1 * | 8/2001 | Schroeder et al. | 222/129.1 |
| 2001/0030308 | A1 * | 10/2001 | Schroeder et al. | 251/129.15 |
| 2002/0056721 | A1 * | 5/2002 | Phillips et al. | 222/1 |
| 2002/0084284 | A1 * | 7/2002 | Landers et al. | 222/129.1 |
| 2002/0092866 | A1 * | 7/2002 | Newman et al. | 222/146.6 |
| 2004/0217130 | A1 * | 11/2004 | Kado et al. | 222/129.1 |
| 2004/0245287 | A1 * | 12/2004 | Fox | 222/129.1 |
| 2005/0269360 | A1 * | 12/2005 | Piatnik et al. | 222/129 |
| 2006/0097009 | A1 * | 5/2006 | Bethuy et al. | 222/129.1 |
| 2007/0267441 | A1 * | 11/2007 | van Opstal et al. | 222/129.4 |
| 2008/0217357 | A1 * | 9/2008 | Hecht | 222/108 |
| 2008/0223876 | A1 * | 9/2008 | Schroeder | 222/144.5 |
| 2009/0056813 | A1 * | 3/2009 | Bethuy et al. | 137/12.5 |
| 2009/0084817 | A1 * | 4/2009 | Schroeder et al. | 222/144.5 |
| 2009/0107559 | A1 * | 4/2009 | Edwards et al. | 137/15.21 |
| 2010/0033446 | A1 * | 2/2010 | Romanyszyn et al. | 345/173 |
| 2011/0073617 | A1 * | 3/2011 | Martindale et al. | 222/144.5 |
| 2011/0290336 | A1 * | 12/2011 | Campbell et al. | 137/15.05 |

* cited by examiner

5 Head Dispenser

MULTI-FLAVOR MECHANICAL DISPENSING VALVE FOR A SINGLE FLAVOR MULTI-HEAD BEVERAGE DISPENSER

This application claims priority from, and benefit of, and incorporates herein by reference U.S. Provisional Application Ser. No. 61/678,253, filed Aug. 1, 2012.

FIELD OF THE INVENTION

Multi-flavor mechanical dispenser heads for beverage dispensing machines.

BACKGROUND OF THE INVENTION

Known in the art are lever actuated, electronically controlled (principally through solenoid valves) multi-station, multi-single flavor head beverage dispensers, with each station having a dispensing head adapted to dispense a single beverage (see FIG. 9) That is to say, there are tens of thousands of electrically actuated multi-station beverage assemblies, where each station is actuated by a cup striking a lever and will dispense a single beverage into the cup. Four, five, six or more stations are laid adjacent to one another to provide the user with four, five or six drink options.

Some of these multi-station single beverage dispenser head units are provided with frame and other structural elements that support a backblock for each dispensing station. Such backblocks are known in the art and typically receive syrup from a concentrate (such as bag-in-box) under pressure, as well as water (carbonated or non-carbonated) under pressure. The backblocks typically have a pair of male barbs to provide the syrup and diluent to a valve having user operated on/off mechanisms. Flow control elements may also be provided to generate a controlled ratio of syrup/water to a post-mix valve.

In order to add additional flavors to such multi-flavor dispensing units having multiple stations, each station dispensing a single beverage, one must provide a new assembly. For example, some manufacturers provide a five station model. If the user wishes to dispense additional flavors, they typically will need to obtain a new machine having additional stations.

SUMMARY OF THE INVENTIONS

Applicant provides, in one embodiment, a multi-flavor head for mechanical retrofit for replacement of one of the single flavor electronically actuated beverage dispenser head. Applicant provides a dispensing valve assembly adapted to retrofit to an existing two fluid backblock (carrying primary fluids) and dimensioned for receipt into an existing housing or provided housing, which is capable of retrofitting the single beverage dispensing capabilities of the preexisting dispensing head to a dispensing head with multi-flavor capabilities.

For retrofitting to a backblock of an existing multi-head, multi-backblock beverage dispensing machine, Applicant provides a valve having, in one embodiment, walls adapted to fluidly engage a backblock. A primary circuit has a pair of primary circuit pathways adapted to receive pressurized syrup and pressurized water from the backblock. The valve provides a multiplicity of supplemental circuit pathways adapted to receive (typically not from a backblock) a multiplicity of different syrups from a multiplicity of different pressurized syrup sources. Flow control elements in the valve engage the circuits to control the rate of flow of fluid therethrough. Operator pushbutton controlled valved chambers open and close the circuit pathways. A post-mix valve assembly mixes a syrup from a circuit pathway with the pressurized water from the primary circuit.

A multi-head post-mix beverage dispensing machine may be provided, the multi-head post-mix beverage dispensing machine comprising a dispensing machine body including a multiple of similar backblocks, one or more single flavor heads each adapted to carry primary circuits comprising a flow controlled syrup circuit pathway and a diluent circuit pathway, for dispensing from a dispensing valve having a post-mix nozzle. At least one multi-flavor head is adapted to carry the primary circuit and a supplemental circuit having multiple flow controlled syrup circuit pathways, the multi-flavor head having an actuator for selecting one of a multiplicity of drinks for dispensing from a post-mix valve engaged therewith.

BRIEF DESCRIPTION OF THE DRAWINGS

FIG. 5A showing both primary and supplemental circuits; FIG. 5B, the primary circuit; and FIG. 5C the supplemental circuit.

DETAILED DESCRIPTION OF THE PREFERRED EMBODIMENT

Figure 1:
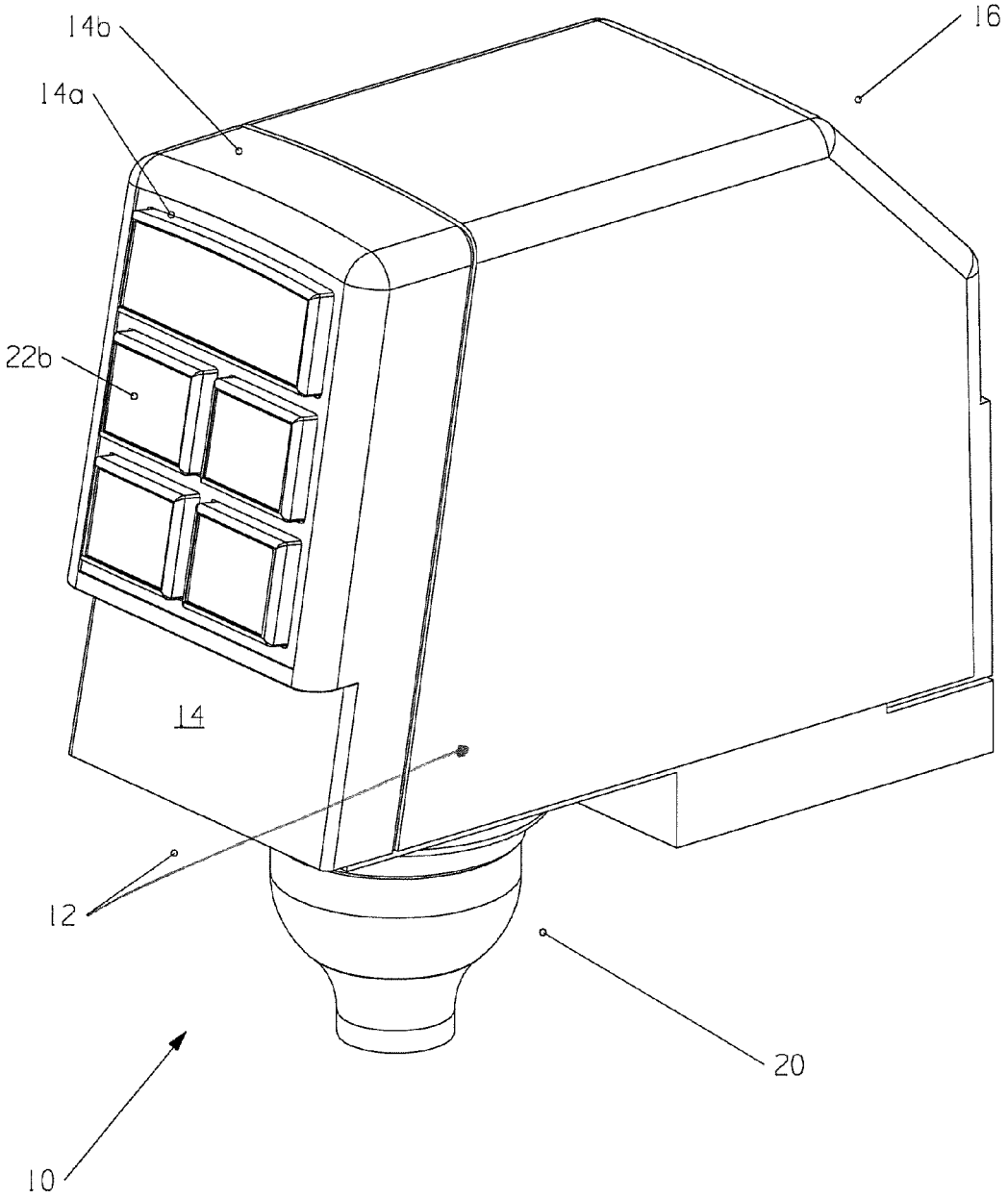
FIG. 1 is a perspective exterior view of a dispensing head containing Applicant's novel dispensing valve assembly configured to fit within a housing, which may be a preexisting housing of a preexisting dispensing machine.

Turning now to FIGS. 1, 2, 3, and 3A, a multi-flavor (hereinafter usually "dispensing head") dispensing head 10 is seen. Dispensing head 10 is seen to have a housing 12. Housing 12 may include a front wall 14, which may include a window portion 14*a* providing access to a pushbutton assembly 22 of Applicant's dispensing valve assembly 18 (see FIG. 1A) and a perimeter 14*b*. Shroud 16 may be an existing shroud of an existing single flavor head, multi-head beverage dispenser assembly (see FIG. 9) or shroud 16 may be dimensioned to retrofit and lay adjacent such preexisting unit. In either case, shroud 16 along with front wall 14 is designed to, in one embodiment, retrofit an existing multi-head typically post-mix beverage machine so that it appears substantially identical to, in outward appearance, adjacent unmodified stations—excepting, typically, window 14*a* and button assembly 22.

It is seen that Applicant's shroud 16 may include shroud element 16*a* that may engage cooperative elements resiliently, which cooperative elements may be on the inner surface of perimeter 14*b*, so as to hold the front wall to the shroud. Moreover, screws 22*a*' may engage button assembly 22 to engage the same to Applicant's dispensing valve assembly 18 (see FIG. 1A), and also allow a membrane button cover 22*b* to, in one embodiment, cover the buttons seen in FIG. 3A with the membrane button cover.

Figure 5:
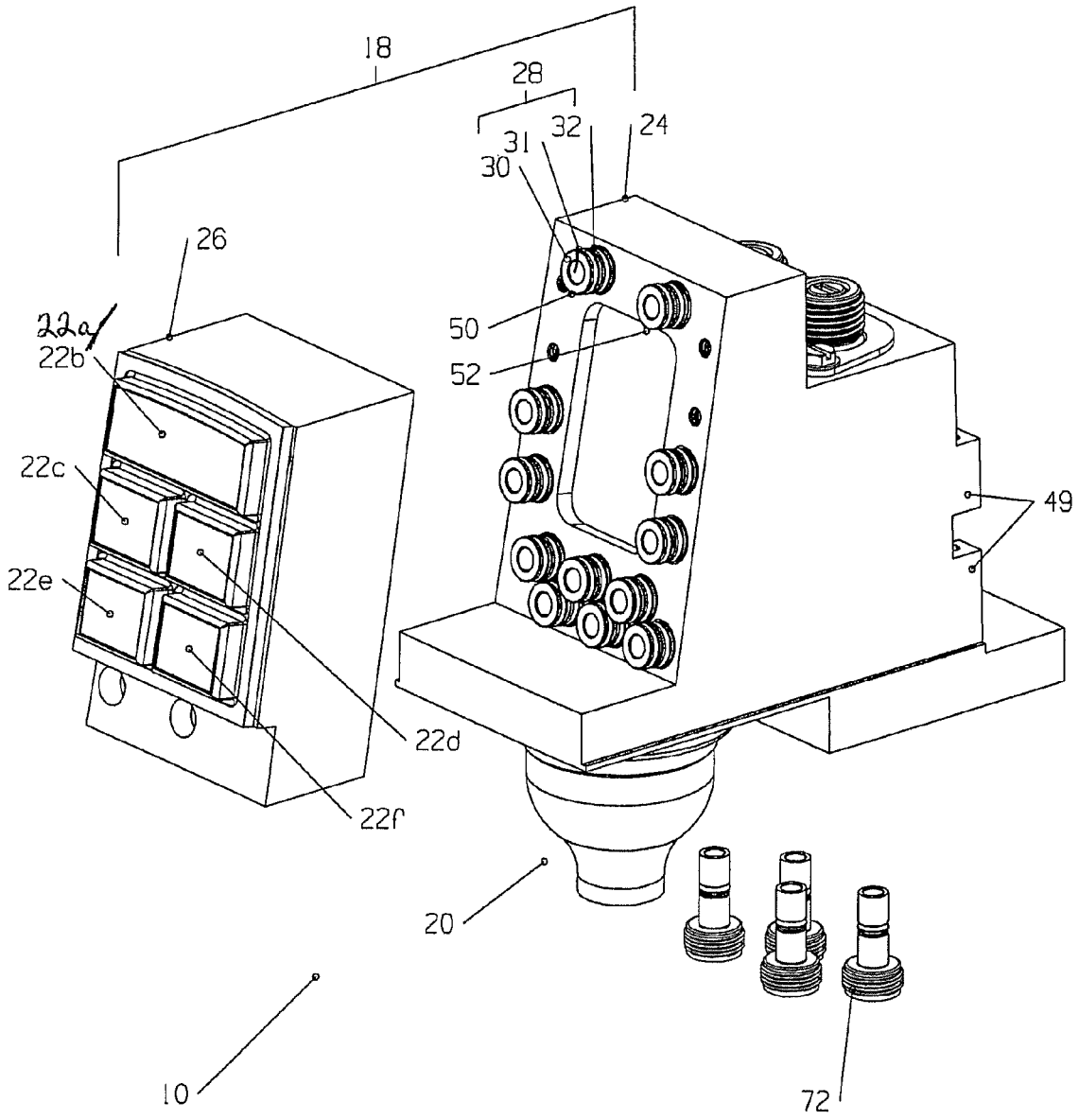
FIG. 5 is a perspective view of Applicant's dispensing valve assembly.
Figure 5A:
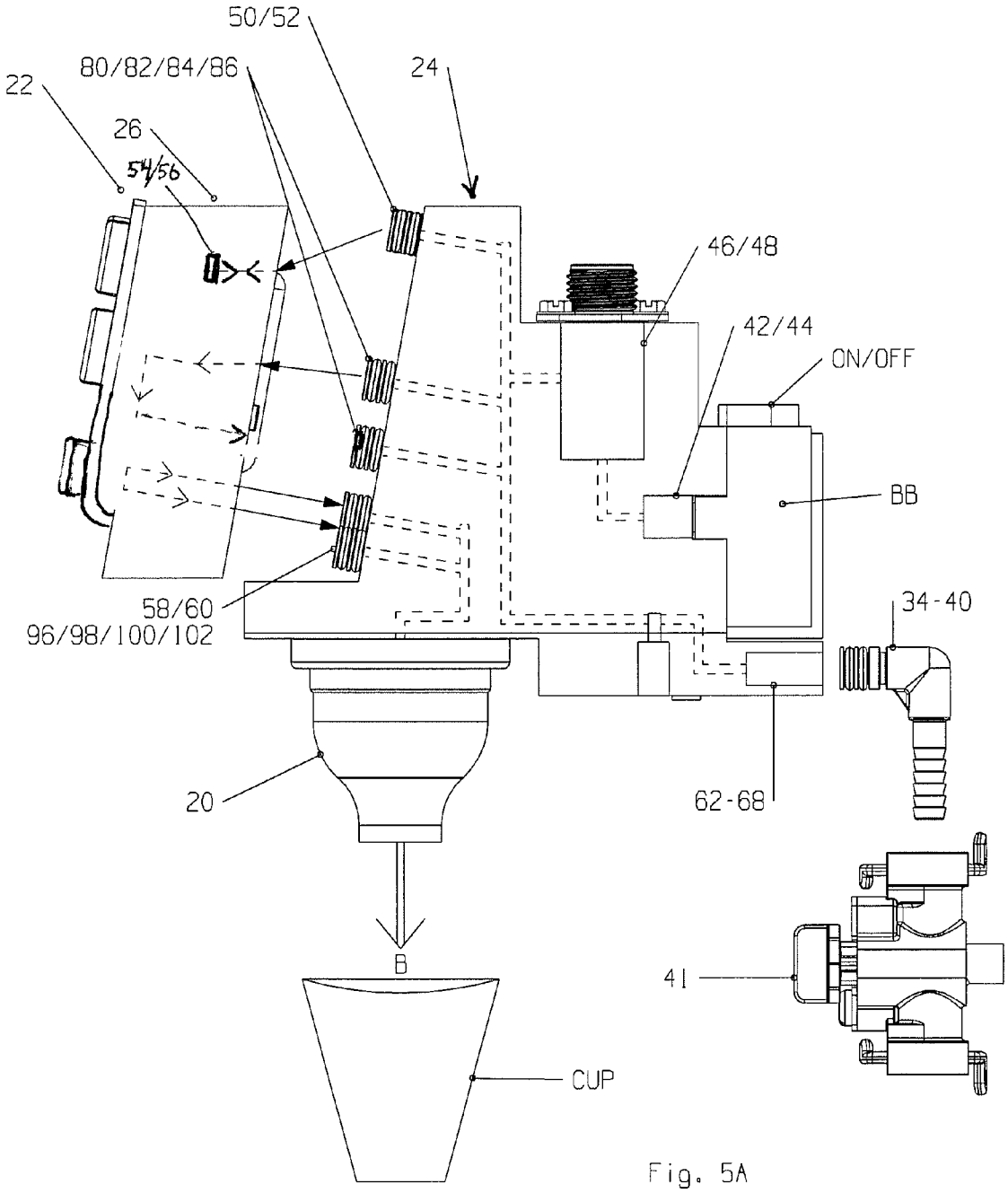
FIGS. 5A, 5B, and 5C are simplified schematic like views of the flow channels and other elements of Applicant's dispensing valve assembly.
Figure 5B:
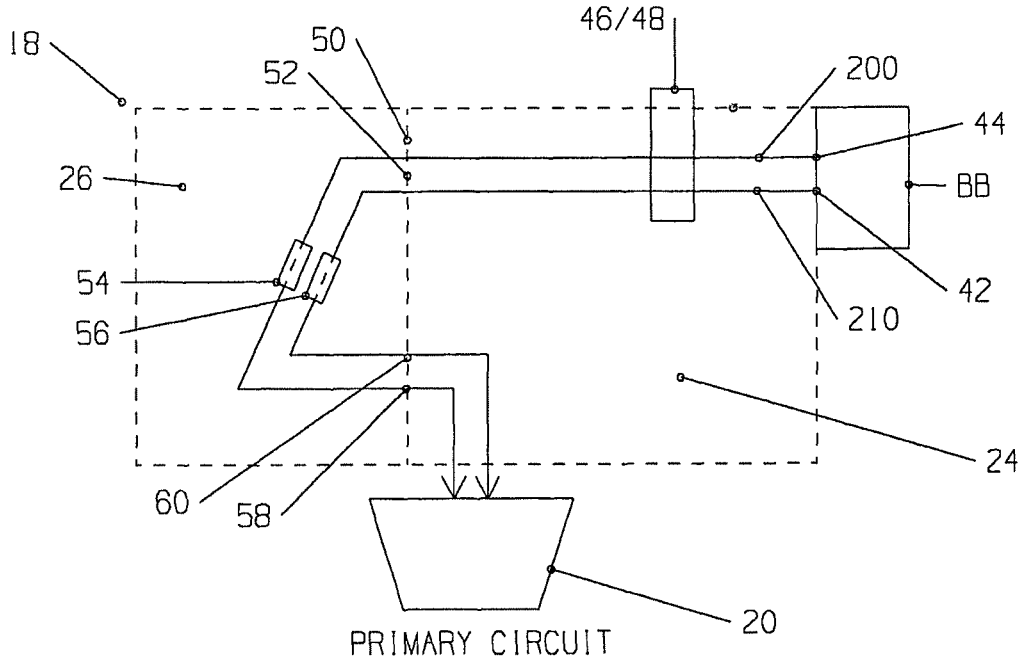
Figure 5C:
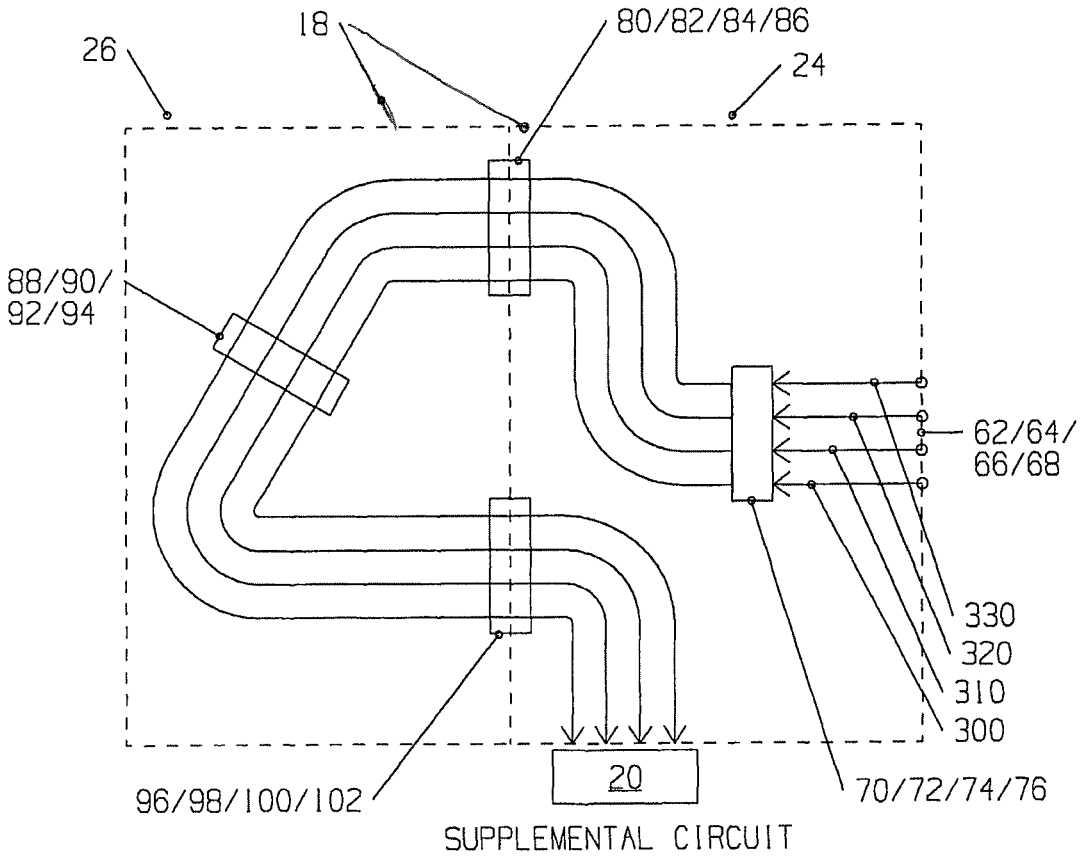

Reference is first made to the simplified schematic views of FIGS. 5A, 5B, and 5C, as well as the Summary Of The Invention set forth in the paragraphs above, to discuss, functionally, what is achieved by various embodiments of Applicant's device as disclosed herein.

Figure 9:
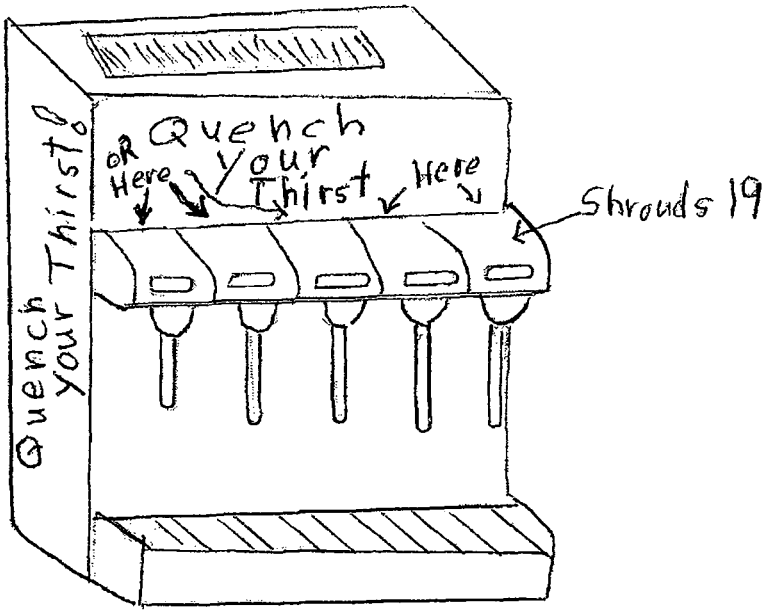
FIG. 9 is a prior art multi-head beverage dispensing machine, wherein each head dispenses a single flavor, typically comprising a syrup and a diluent.
Figure 9A:
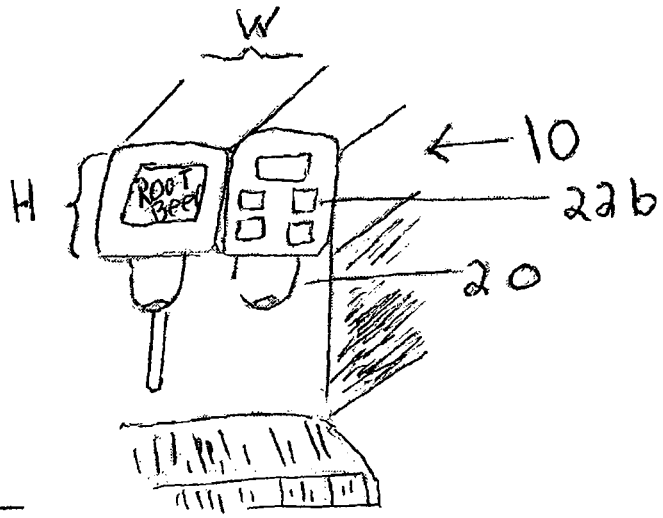
FIG. 9A is a view of Applicant's dispensing machine with both single and multiple beverage dispensing heads thereon.

The figures show a backblock BB, such as provided for in an existing multi-head dispensing machines (see, for example, FIG. 9A). Backblocks BB receive pressurized water (carbonated or non-carbonated) and syrup. Applicant provides a retrofit, including a multiple of syrup couplers 34/36/38/40 for delivery of, in one embodiment, four different syrup flavors, different from each other and different from the one syrup flavor delivered through the backblock to dispensing valve assembly 18. The circuit through the valve into the nozzle 20 that originates at the backblock is sometimes referred to as the primary circuit, which has two pathways, a primary water circuit or pathway and a primary syrup circuit or pathway. A supplemental circuit is provided for delivering a multiplicity of different flavored syrups through a multiplicity of supplemental circuit pathways, each ending in the nozzle 20, typically a post-mix nozzle. All circuit pathways are subject to flow control elements (typically non-electrical) for delivery of a controlled fluid volumetric flow downstream thereof despite fluctuating upstream pressures. All circuit pathway are also provided with, typically, mechanical push-button butterfly valve controls, such as those controls disclosed in the patents incorporated herein by reference.

Turning to FIG. 5B, fluid flow circuits or pathways 200/210 illustrate the primary circuit and one of 200/210 is adapted to carry water (carbonated or soda) and the other syrup. Flow control elements 46/48, such as those known in the art, are seen to be located upstream of flow control body/poppet valve body couplings 50/52 and downstream thereof are button controlled poppet valve chambers 54/56. Button control poppet valve chambers are mechanical on/off controls for controlling the flow of fluids through each circuit pathway and are known in the art. Couplers 58/60, one of which carries water and the other carries syrup, will couple (in a fluid-tight manner) flow control body 24 to poppet valve body 26.

FIG. 5C illustrates supplemental circuit pathways 300/310/320/330, which comprise self-adjusting flow control or manual flow control elements 70/72/74/76. Downstream of these flow control elements are poppet valve chambers 88/90/92/94. The nature of the button assembly 22 and the button control poppet valve chambers 54/56/80/90/92/94 (five syrup, one water) are known in the prior art and illustrated in the patent documents incorporated by reference herein. Through the operation, such as pressing of a button for a selected syrup, the button assembly will open the poppet valve on the water circuit and the one of the five different syrup selections that the button represents. For example, depressing a button for selecting Root Beer among the five drinks available will activate the poppet valve for the syrup circuit pathway (whether the one in the primary or whether it is one of the supplemental circuit pathways) at the same time that the button assembly opens the water, and both fluids will be directed under the upstream pressure downstream to the post-mix nozzle for post-mix dispensing into a cup.

Turning to FIGS. 1A, 4, 4A, 5, and 6, details of Applicant's dispensing valve assembly 18 may be seen. Applicant's dispensing valve assembly 18 is seen to comprise two portions, a volumetric flow control body 24 (upstream) in a rearward position and a poppet valve body 26 (flow on/off) in a forward position (rearward and forward being with respect to the dispensing machine, which dispenses at the front, see FIG. 9, for example). Flow control body 24 and poppet valve body 26 engage one another, typically through the use of screws. Flow control body 24 is adapted to removably and typically tool-lessly form a fluid tight engagement with a pair of male barbs of backblock BB, which may be a backblock of an existing multi-head machine. If backblock BB is from an existing machine, the backblock provides, under pressure, a syrup and a diluent, such as water or soda water. Moreover, the backblock typically includes hand operated rotatable on/off valves, such that pressurized fluid flow to the dispenser head may be shut off. Moreover, existing backblocks typically include connector elements CE to connect with the valve assembly to which the backblock and the primary circuit connectors (see FIG. 4) engage. That is to say, in FIG. 4, backblock BB may be an existing backblock with male barb primary circuit connectors delivering pressurized syrup and water to a valve downstream thereof, which may be Applicant's dispensing valve assembly 18, which may engage the existing backblock through fluid tight engagement to the primary circuit connectors and the existing connector elements CE.

Figure 6:
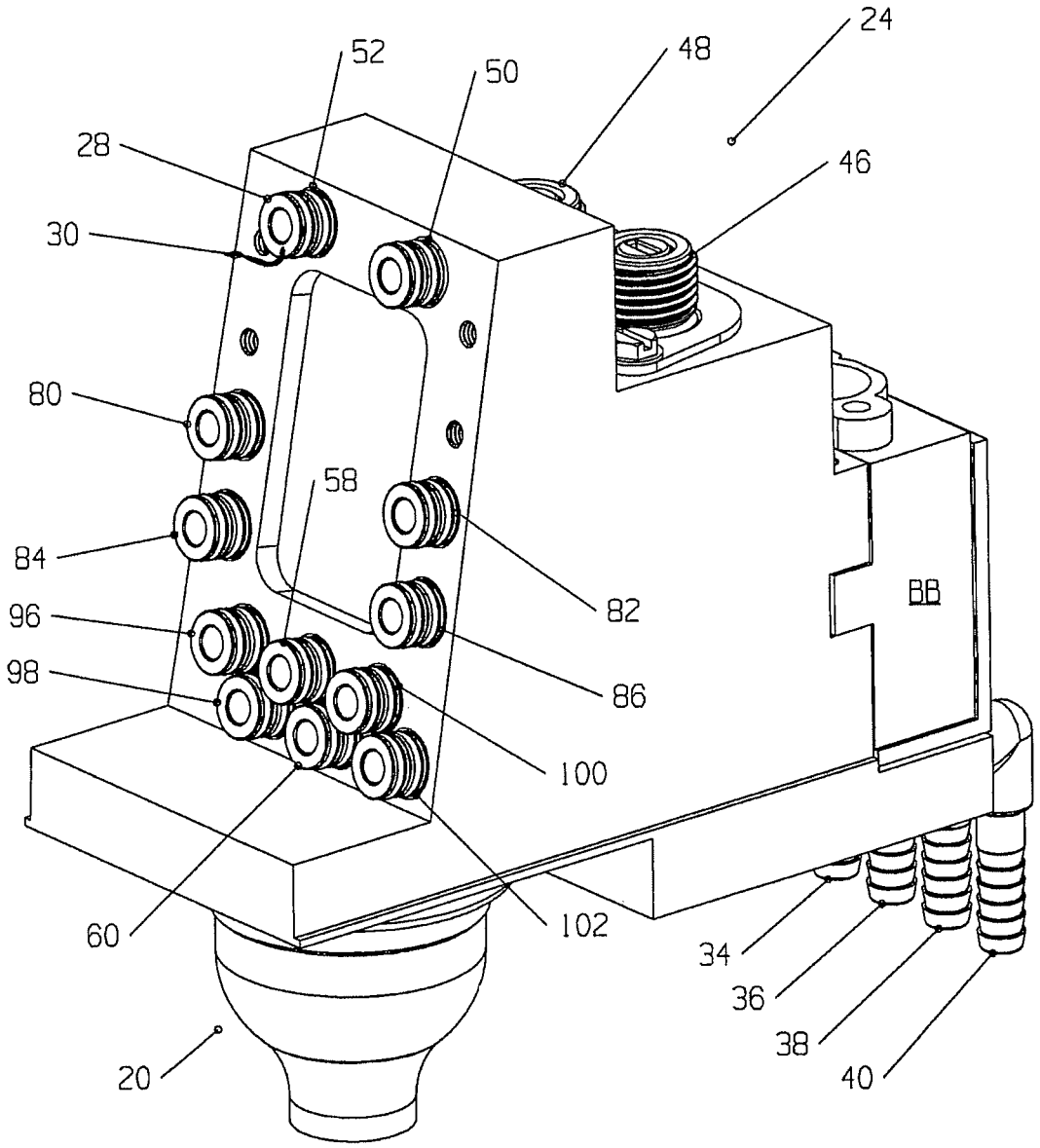
FIG. 6 is a perspective view of the flow control body of Applicant's dispensing valve assembly.

FIG. 6 also illustrates that, in one embodiment, on/off valves 41 and/or self-adjusting flow control elements 48 may be added upstream of where the supplemental syrup engages valve assembly 18.

Thus, Applicant's dispensing valve assembly 18 is, in one embodiment, adapted to engage, in ways known in the art, an existing backblock and is dimensioned to be substantially enclosed within the general dimensions of an existing housing 12, albeit with, in one embodiment, modifications including window 14*a*.

Figure 1A:
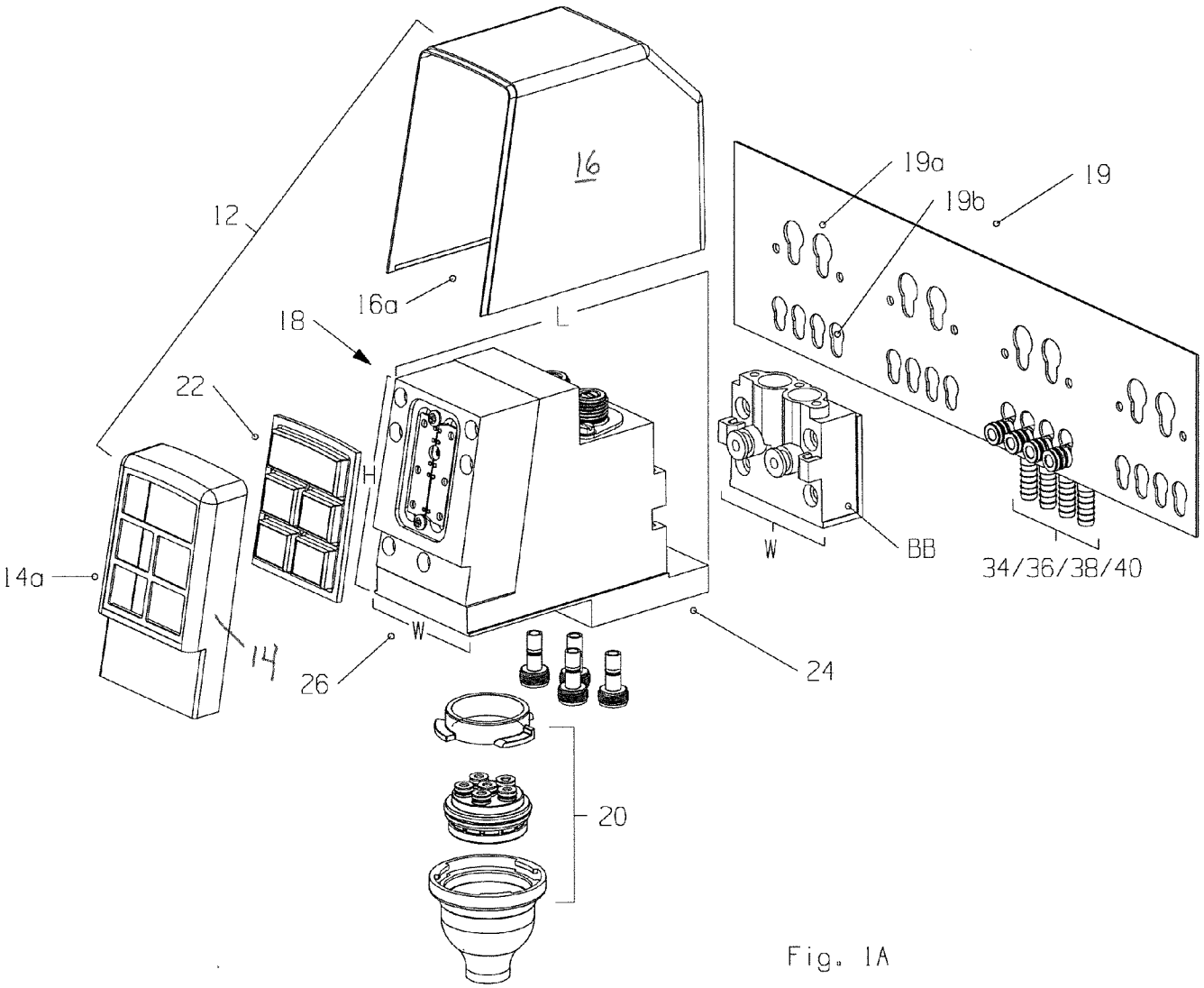
FIG. 1A is an exploded view of FIG. 1 showing Applicant's dispensing valve assembly, as well as a backblock and Applicant's faucet plate.
Figure 2:
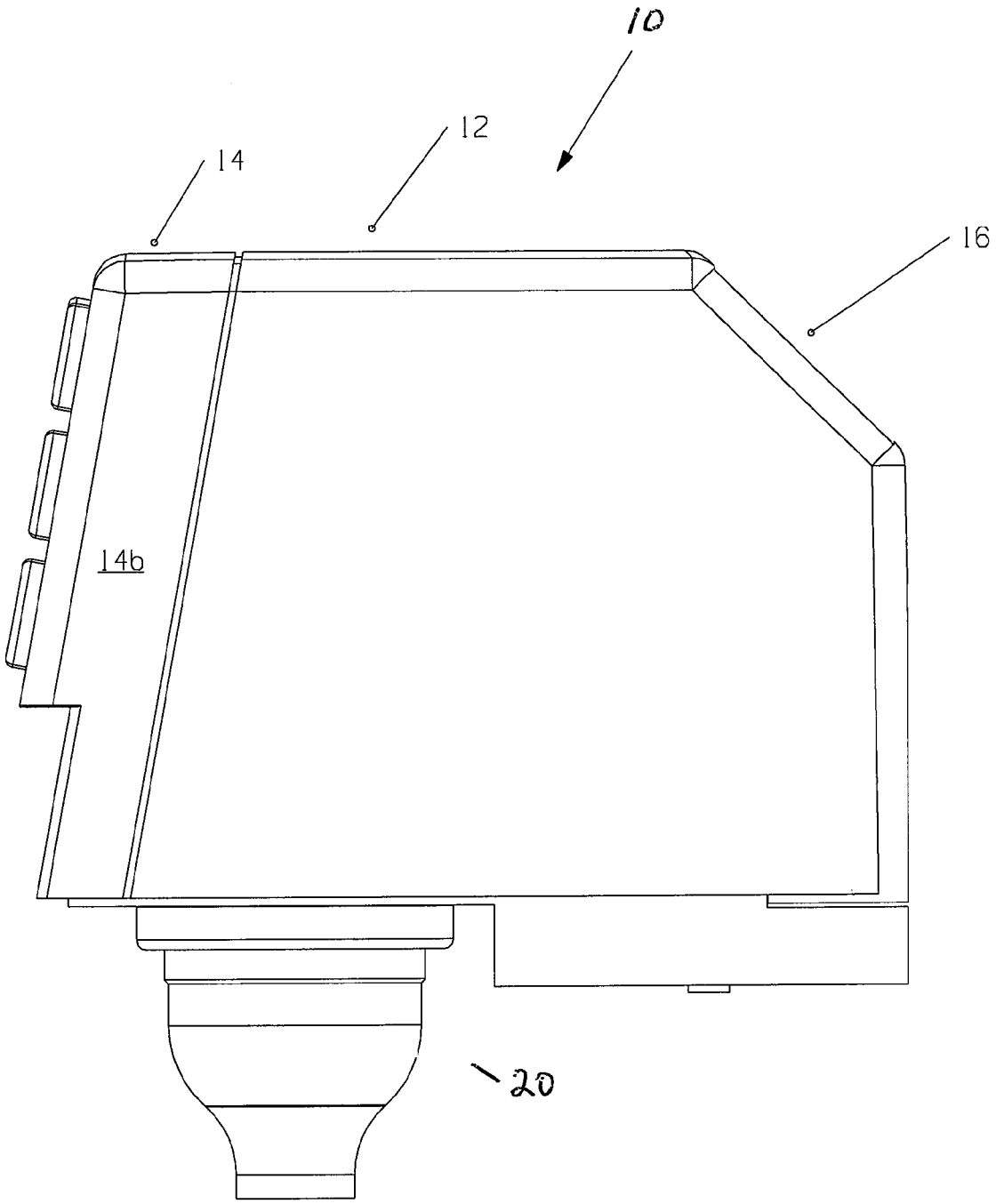
FIGS. 2 and 3 are side elevational and front views, respectively, of FIG. 1.

Applicant may provide a faucet plate 19 as seen in FIG. 1A, which may, in one embodiment, replace an existing faucet plate of an existing multi-dispenser machine like the machine shown in FIG. 9. Applicant's faucet plate 19 may differ from existing faucet plates or may retrofit in place of existing faucet plates in providing multiple syrup source coupler keyholes 19*b* adjacent to and, typically, below backblock keyholes 19*a*, which backblock keyholes 19*a* are positioned to hold backblock BB with respect to other structural elements of prior art dispensing machines in the same place position-wise.

Turning now to details of the manner in which flow control body 24 engages poppet valve body 26, there are seen to be a multiplicity of fluid connectors 28 for engaging flow control body to poppet valve body fluid tight couplings. FIG. 5 illustrates that such fluid connectors 28 may include a cylindrical body 30 having a channel 31 therethrough and a multiplicity of O-rings 32 in grooves on the exterior surface of body 30. In another embodiment, all fluid connectors between flow control body 24 and poppet valve body 26 may be "O" rings adapted to be received in grooves surrounding the channel junctions, the grooves in either or both mating faces. Body 30 is dimensioned for partial receipt into recesses in each of the two bodies 24/26 to allow flow control body 24 and poppet valve body 26 to fluidly engage in a sealed fashion so as to provide fluid flow from one body to the other through channels 31 as set forth in more detail below. It is seen that there is a multiplicity of fluid connectors 28 (see, for example, FIG. 6) adapted to be received into a multiplicity of recesses on the backside of poppet valve body 26 (see, for example, FIG. 8). Any suitable fluid-tight couplings will work.

Turning to FIGS. 5A-5C, flow control body 24 functionally achieves fluid tight coupling to primary circuit inlets 42/44 (connecting to male barbs in one embodiment on existing backblock). Flow control body 24 further achieves flow control of a pair of primary fluid flow pathways or circuits 200/210 that typically originate at backblock BB and may be pressurized water (carbonated or non-carbonated) and pressurized syrup. Flow control elements 46/48 are adapted to be received into the flow control body 24 downstream of primary circuit inlets 42/44. Primary flow control elements 46/48 may be self-adjusting as known in the art, for example, Schroeder America, San Antonio, Tex., Part No. 2770001 or any other flow control. Downstream of primary circuit inlets 42/44, flow controlled fluid (water and syrup) are provided at flow control body/poppet valve body couplings 50/52, which show the locations of fluid connectors 28 to show fluid flow from the primary circuit from flow control body 24 into poppet valve body 26. Channels are provided, typically machined in ways known in the art, to provide functionally for the primary and supplemental circuits as illustrated in FIGS. 5A-5C.

Figure 6A:
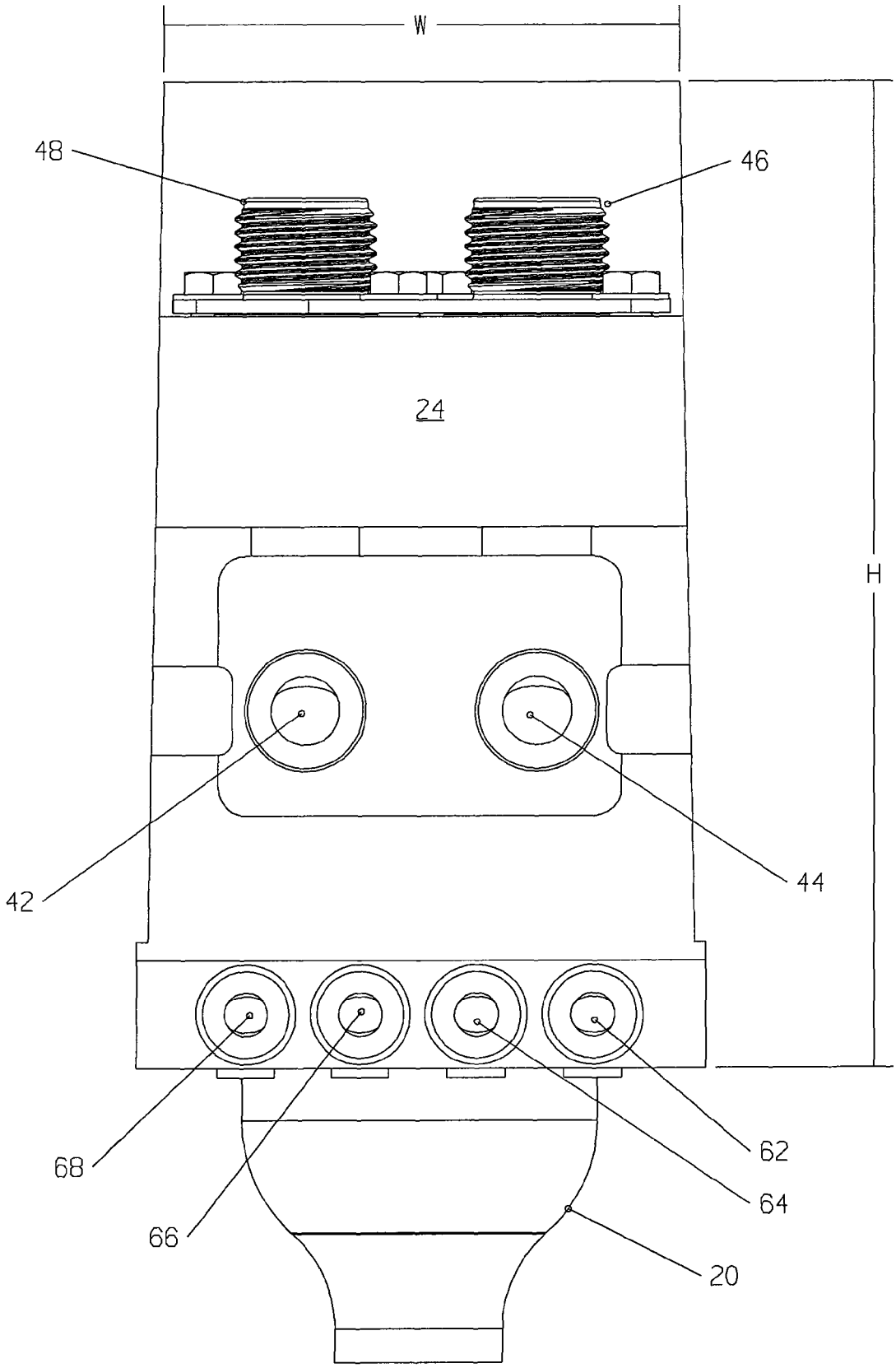
FIG. 6A is a rear elevational view of an embodiment of Applicant's flow control body.
Figure 6B:
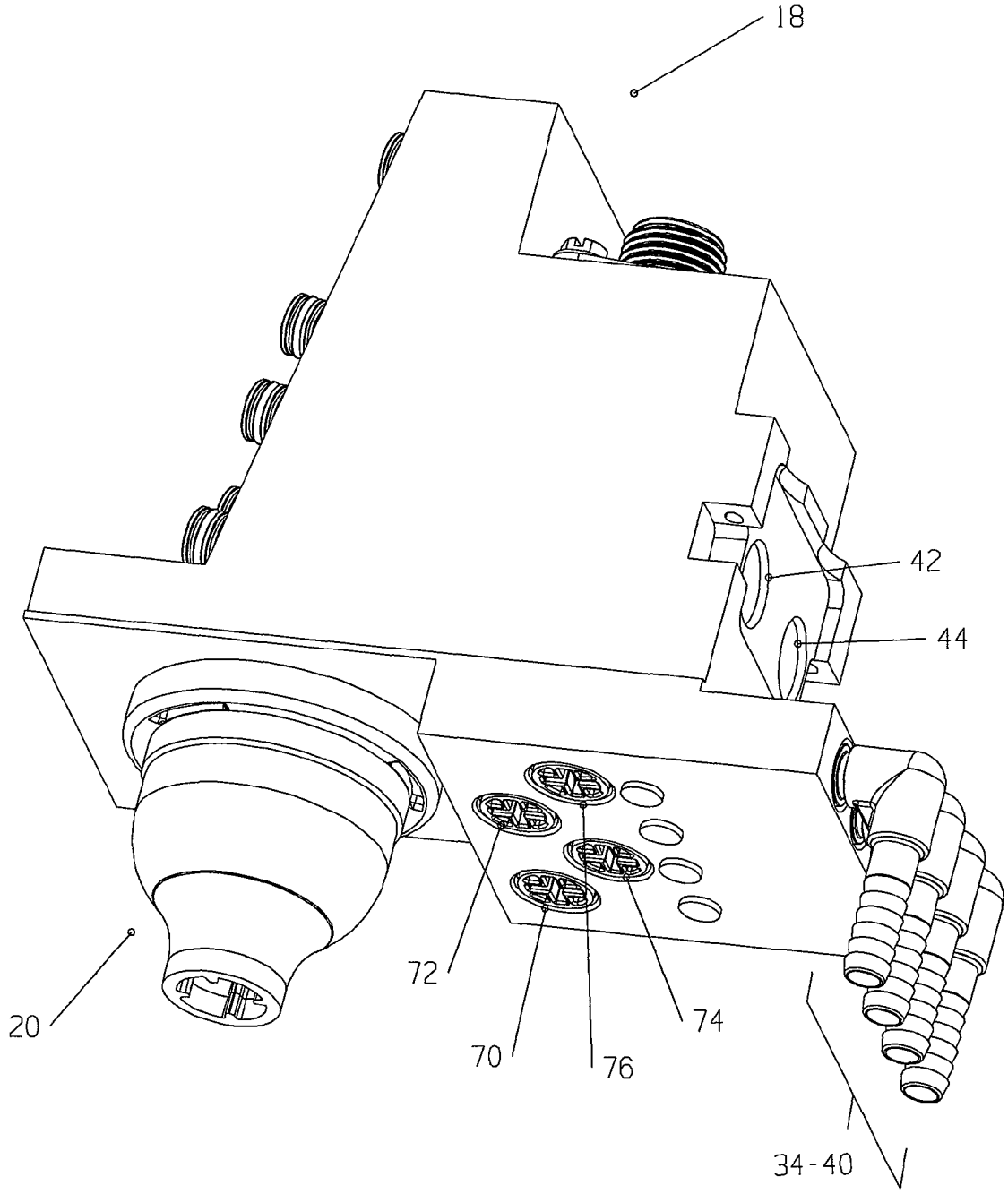
FIG. 6B is a perspective view of the underside of the dispensing valve assembly.

Poppet valve body 26 is provided with a multiplicity of button controlled poppet valve chambers 54/56 (in primary circuits, 200/210) (see FIGS. 5A and 5B), as well as a multiplicity, here, four, poppet valve chambers 88/90/92/94 for syrup fluids in a supplemental circuit, as illustrated in FIGS. 5A and 5C. Here, four supplemental circuits or pathways 300/310/320/330 are provided to give additional flavor options (pressurized syrup) from what was once a dispensing head having only a primary circuit and dispensing only a single beverage option. Here, Applicant provides in both a flow control body 24 and a poppet valve body 26 defining a dispensing valve assembly 18 configured to adapt to, in one embodiment, a preexisting dispensing machine providing a multiplicity of additional syrups for Applicant's supplemental circuit (here, four additional syrup sources) (see FIG. 9A). Supplemental circuits or pathways are provided in flow control body 24 having supplemental circuit inlets 62/64/66/68, typically aligned along a rear wall adapted to receive syrup source couplers 34/36/38/40 in fluid tight couplings. In one embodiment (see FIG. 5A), these couplers are four elbow fixtures with O-rings engaging upstream and downstream ends thereof for receipt into supplemental circuit inlets 62/64/66/68 and downstream end for coupling with four supplemental fluid sources, which may be pump pressurized bag-in-box syrup sources (not shown) through fluid lines known in the art. Multiple individual on/off switches 41 (see FIG. 5A) may be provided upstream or downstream of couplers 34/36/38/40 (upstream shown in FIG. 5A), and before inlets 62/64/66/68. Also, self-adjusting flow control 43 may be seen in FIG. 4A, upstream of valve 18 engaging syrup. In one embodiment, the couplers and inlets are below the backblock and are within the width W and height H of the interior width of shroud 16 (see FIG. 6A). Thus, a supplemental circuit is provided adding flow controlled (typically non-electrical) syrup to a dispensing head. A multi-flavor button assembly 22 is incorporated as now a multiple of flavors are available for dispensing.

Figure 3:
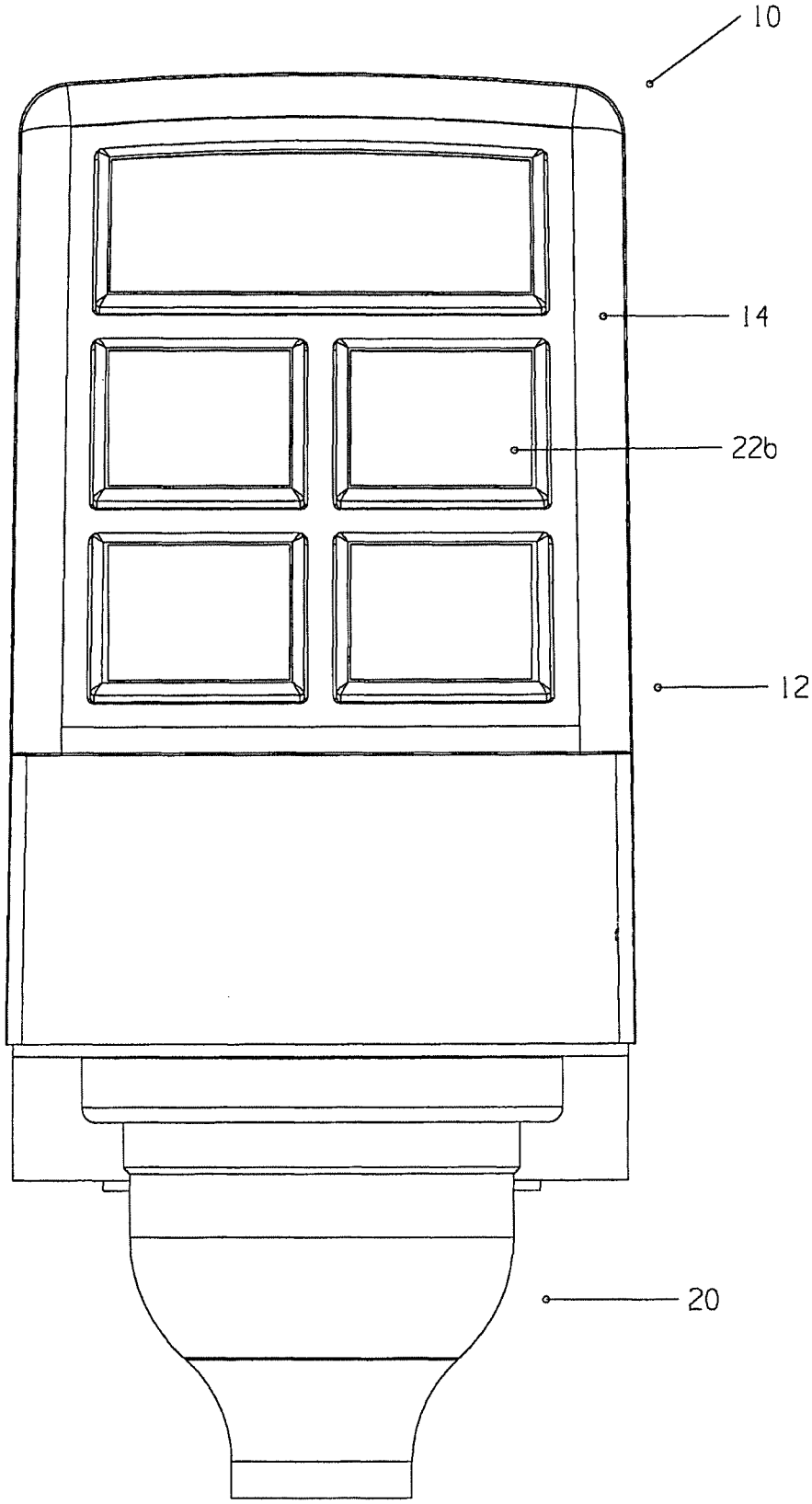
Figure 3A:
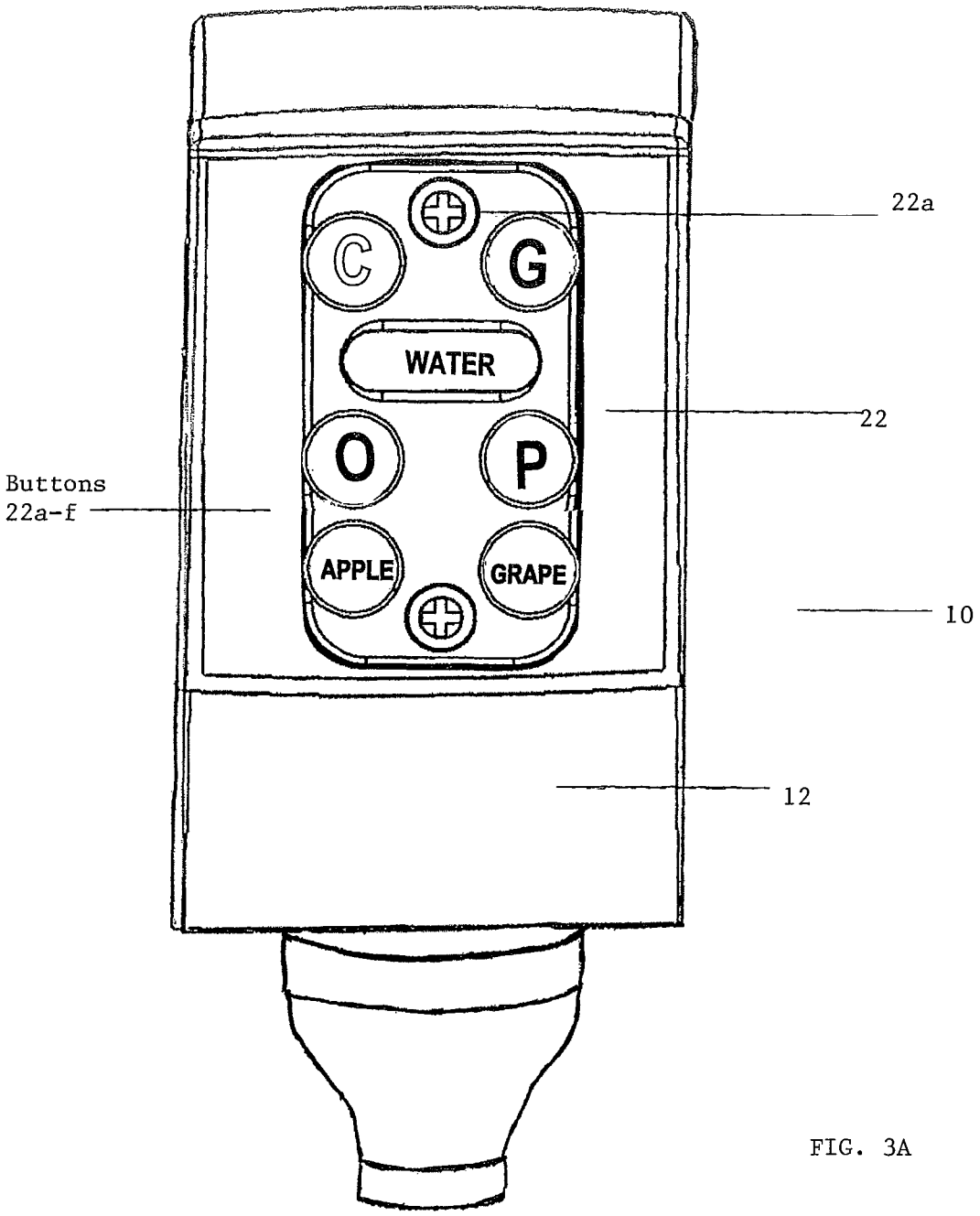
FIGS. 3A and 3B show front elevational and exploded perspective views of an embodiment of Applicant's dispensing head.
Figure 3B:
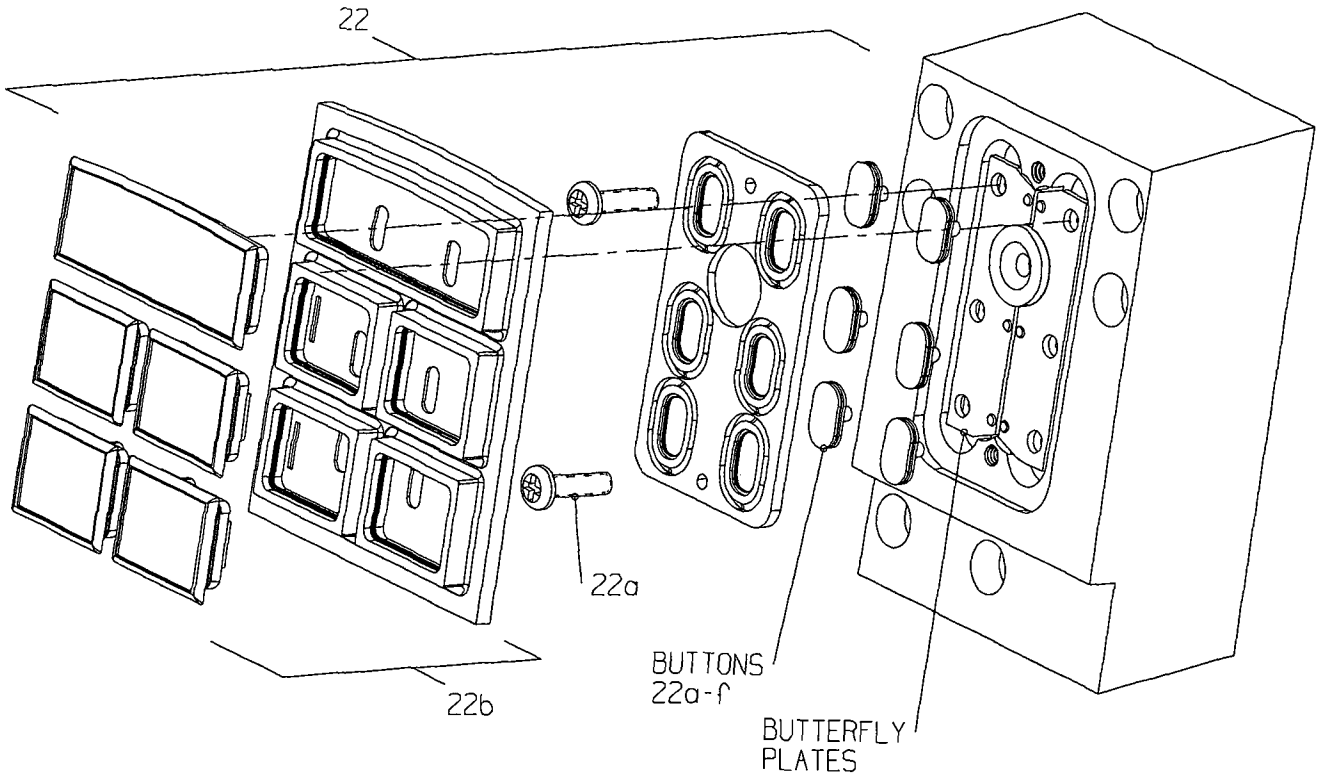
Figure 4:
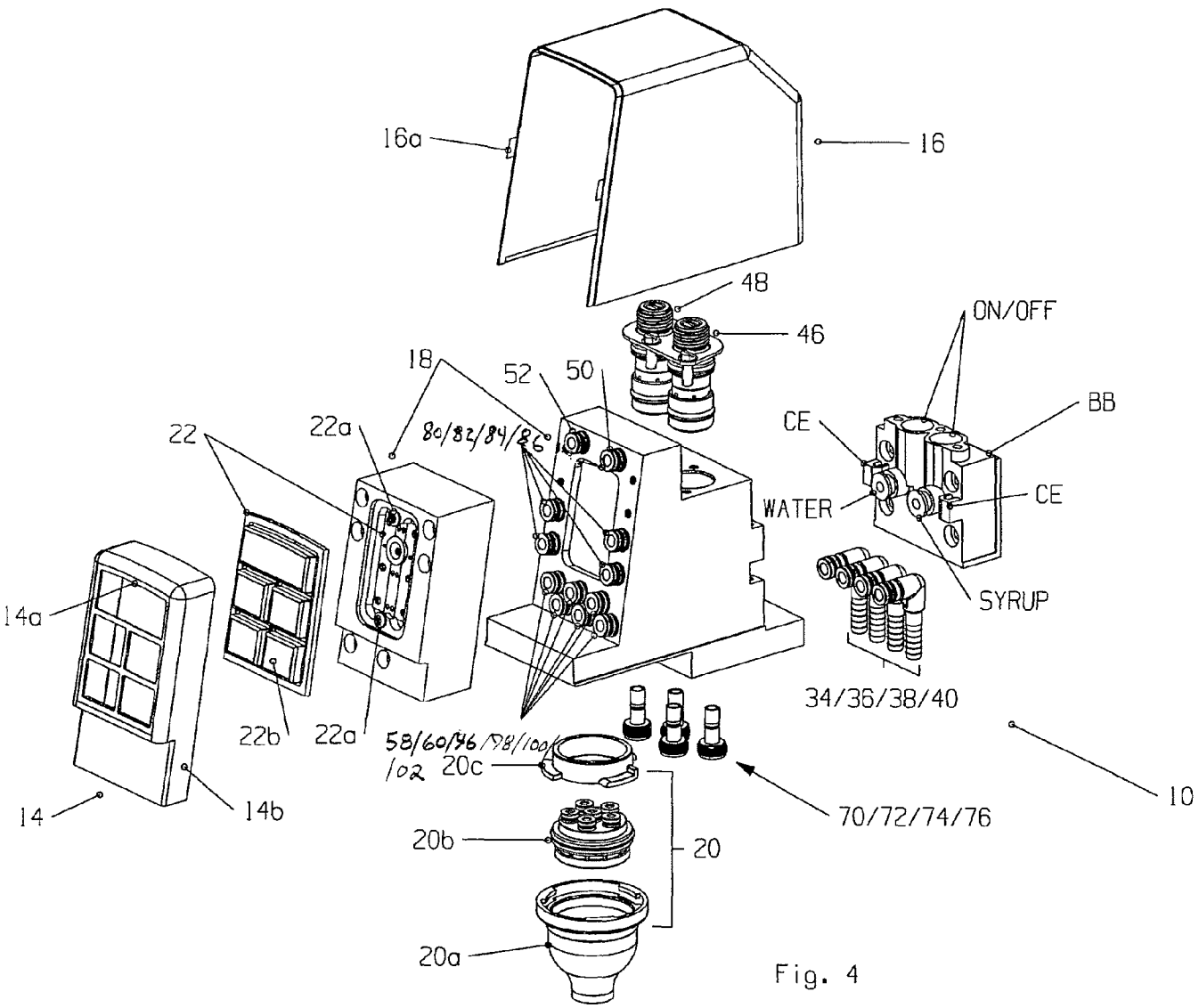
FIG. 4 is an exploded perspective view of an embodiment of Applicant's device.
Figure 4A:
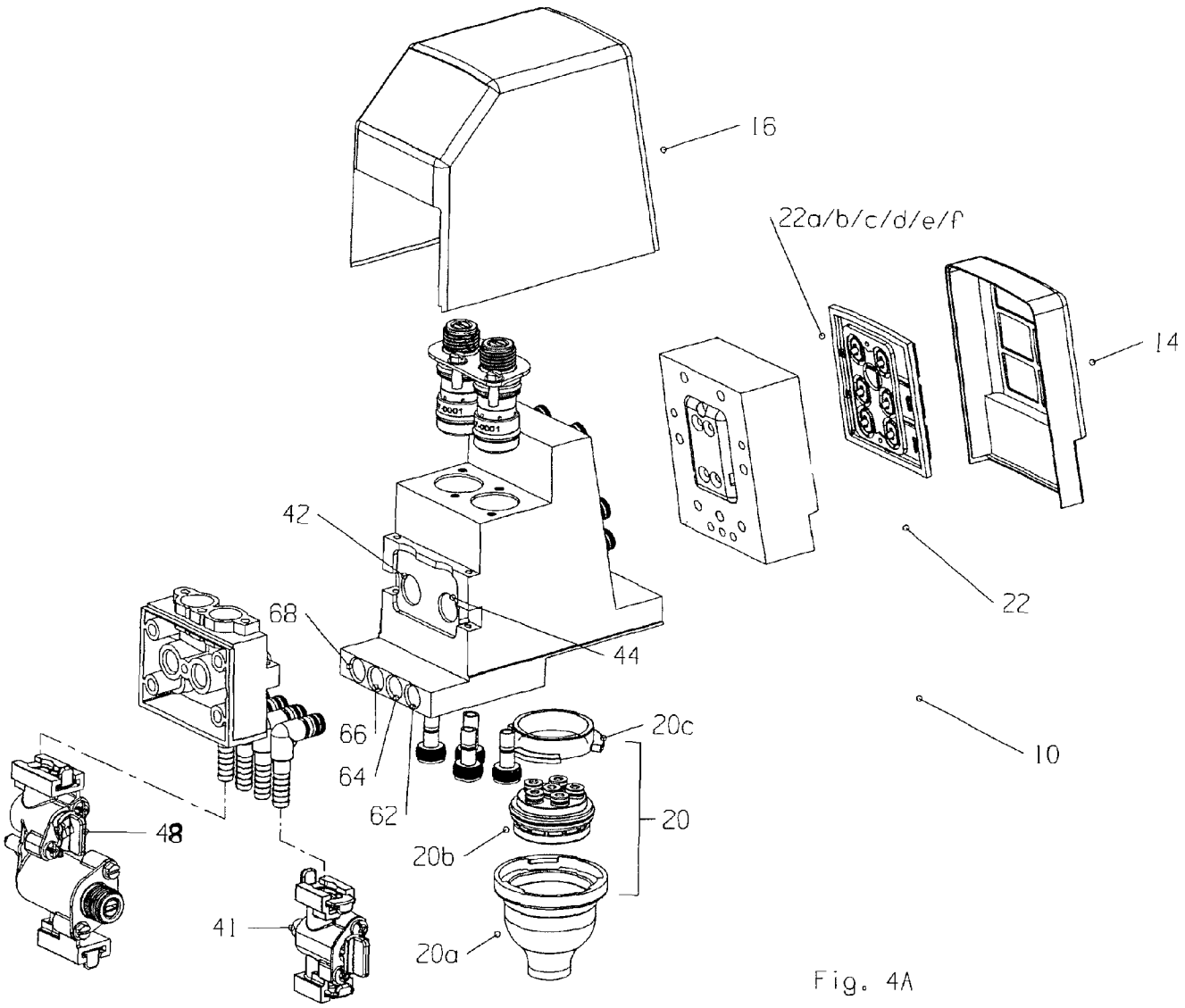
FIG. 4A is an exploded view of Applicant's multi-flavor head.

FIGS. 4 and 5 also illustrate how the flow control elements, such as manual flow controls (fixed orifice flow control, in one embodiment) 70/72/74/76 (Schroeder America Part No. 625-0010), may threadably engage the underside of flow control body 24 to control the flow of fluid in the supplemental circuits downstream thereof. Flow control elements 46/48 of the primary circuit and 70/72/74/76 of the supplemental circuits multiple pathways may be adjusted I-n in known ways to provide the proper mix when button operated poppet valve chambers (a syrup and water) are opened responsive to operator input at one of buttons 22*a*/22*b*/22*c*/22*d*/22*e*/22*f* on pushbutton assembly 22 (membrane covered in all Figures except FIG. 3A). It is noted at this point that one of the six syrup buttons on FIG. 3A may be a "dummy" when there are only five syrup circuits (one from the primary and four in the supplemental). In another embodiment (for example, FIG. 3B), Applicant provides only five selections representing the five different beverages. The six button arrangement is illustrated here in FIG. 3A is used simply because it is available from one of Applicant's existing bar guns. A sixth circuit may be provided as part of the supplemental circuit should a customer request such addition. In the five button embodiment (see, for example, FIGS. 7 and 8), there is no "water only" option. Five buttons, five flavors, see five output valve output coupling recesses 106 in FIG. 8.

Poppet valve body 26 is adapted to receive pushbutton input from a user to open a water and selected one of five different beverages for dispensing (for so long as the selected button is depressed) into a cup held beneath Applicant's post-mix nozzle 20. In Applicant's supplemental circuit, multiple fluid connectors 28 may be used at flow control/poppet valve body couplings 80/82/84/86 carrying flow controlled pressurized syrup into the poppet valve body and at flow control body/poppet valve couplings 96/98/100/102 carrying the flow controlled syrup out of poppet valve body 26 and back into flow control body 24 for post-mix dispensing in Applicant's post-mix nozzle 20.

Figure 7:
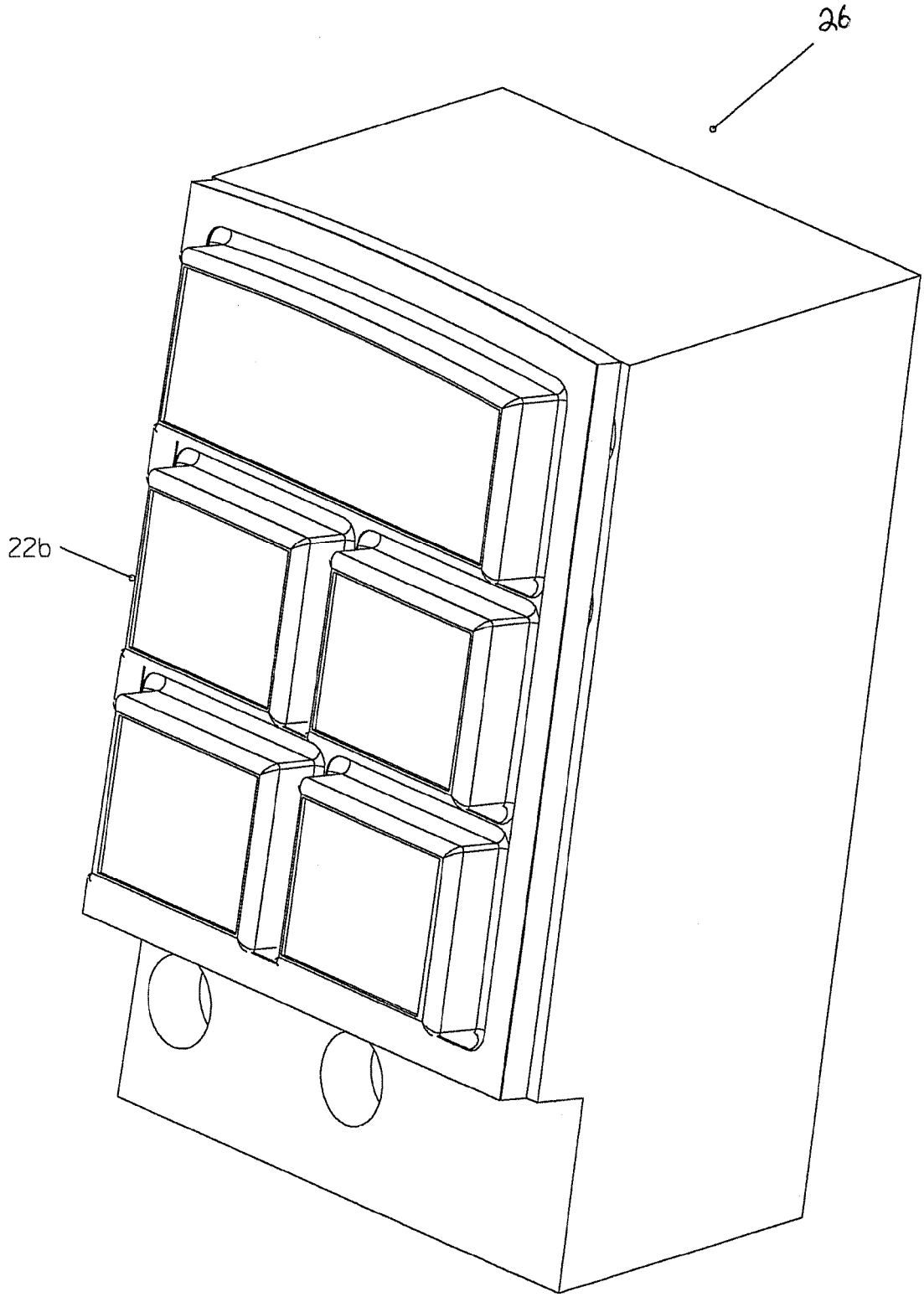
FIGS. 7 and 8 are perspective front and perspective rear views of the poppet valve body of Applicant's dispensing valve assembly.
Figure 8:
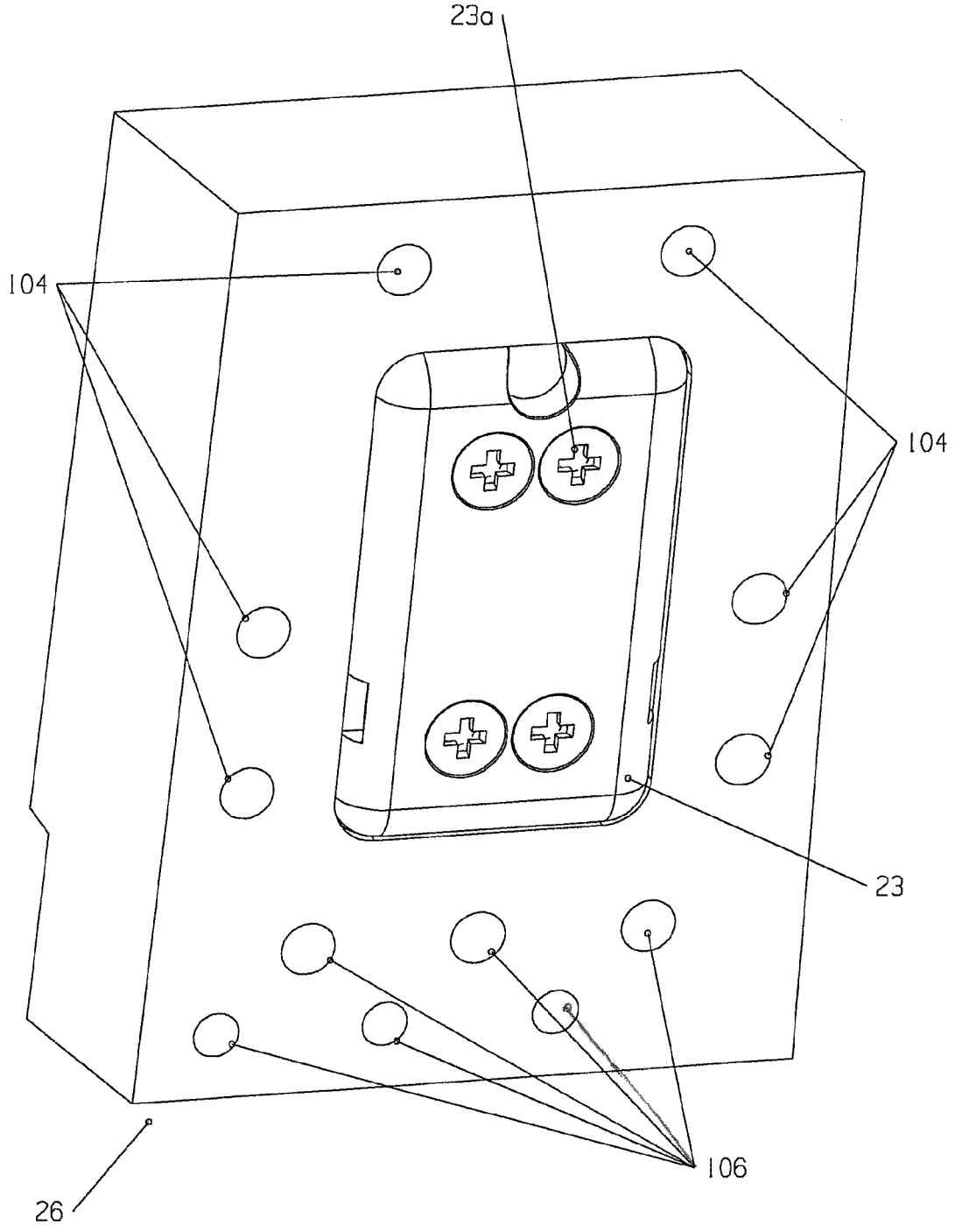

FIGS. 7 and 8 show further details of Applicant's poppet valve body. Poppet valve body coupling recesses 104/106 are illustrated; recesses 104 for receipt of pressurized syrup in the supplemental circuit and primary circuit using a multiplicity of fluid connectors 28 for receipt into recesses 104. Couplings 50/52 are also inlet couplings and are seen at the top of FIG. 8 for carrying pressurized flow controlled water and syrup in the primary circuit into poppet valve body 26. Poppet valve body coupling recesses 106, typically six in number illustrated in FIG. 8, are adapted to receive six fluid connectors 28 for carrying the pressurized button activated fluids from downstream of the fluid chambers into flow control body 24 for delivery to nozzle 20. Thus, pressurized fluid from the primary circuit and the secondary circuit is delivered in flow controlled condition to the six valved chambers, operated by the buttons of the button assembly 22 in the poppet valve body 26. When one of the non-water beverage buttons is pressed, one of the five pressurized flow controlled syrups and the pressurized water will flow out of their respective channels into the post-mix nozzle for dispensing into a cup. Details of one embodiment of the pushbutton assembly and elements thereof, including poppet valves, as well as details of a backing plate assembly 23 attached to a rear face of the poppet valve body by screws 23*a*, may be appreciated with reference to Applicant's U.S. Pat. No. 8,109,413, which patent is hereby incorporated herein by reference. Further guidance, including the use of butterfly plates to simultaneously open a water (or soda water) channel and one of a selected multiplicity of syrup channels, may be found in U.S. Pat. No. 4,986,449, as well as the '457 application, which are incorporated herein by reference.

Details of Applicant's post-mix nozzle 20, which is adapted to engage the two fluids of the primary circuit and the four fluids of the secondary circuit for post-mixing thereof, may be appreciated with reference to Applicant's published U.S. patent application Ser. No. 12/944,447, which is incorporated herein by reference. In one particular embodiment of post-mix nozzle 20, the post-mix valve of FIGS. 12A to 12I of the '457 application is used (see element 2118 of FIG. 12B thereof, for example). Applicant's nozzle assembly 20 may be seen in FIG. 4 to include a housing 20*a*, a diverting assembly 20*b*, and a coupler 20*c*. Coupler 20*c* includes elements adapted to couple to the underside of Applicant's flow control body 24 as seen, for example, in FIG. 4, here, an upper rim thereof. Bosses on coupler 20*c* are seen to engage grooves on the upper perimeter of nozzle housing 20*a*. Diverting assembly 20*b* is designed to receive the pressurized fluid from the six circuits and to deliver the pressurized water (or soda water) adjacent and against the interior walls of nozzle housing 20*a*, while downstream thereof, providing a directed spray of a pressurized syrup against a portion of the inner walls of nozzle housing 20*a*. Further details may be seen in U.S. patent application Ser. No. 12/944,547 incorporated herein by reference.

Representative exterior dimensions of Applicant's dispensing valve assembly 18 (see FIGS. 1A and 6A) are L=5.3", W=2.5", H=3.9" (approximate). While four supplemental circuits are illustrated, any suitable number may be used. While, at least, a retrofit faucet plate 19, front wall 14, and dispensing valve assembly 18 are shown, they may be in any suitable and configured dimension for a new, scratch built multi-head dispensing machine, the valve assembly 18 having the push in, fluid tight fit of the valve 18 illustrated when connecting to multiple syrup sources and a pressurized water source.

Valve bodies 24/26 may be manufactured according to the teachings of U.S. Pat. No. 7,658,006 entitled "Method of Manufacturing A Handle For A Dispensing Head," which patent is hereby incorporated by reference. Moreover, although valve assembly 18 typically comprises two pieces, body 24 and body 26 which fluidly couple as set forth above, in one embodiment, they may be manufactured by multiple plates glued together as a single unit, not two units. When this occurs, fluid connectors 28 are not needed and backing plate assembly 23 is omitted, the springs and other elements of the backing plate assembly being inserted from the front or button assembly end of the one-piece valve body, or built in during manufacturing.

Furthermore, Applicant discloses a dispensing machine comprising a prior art multi-station single beverage dispenser head machine (FIG. 9) in which one or more of the original single beverage dispenser heads have been retrofitted as set forth herein. The result is a "mixed machine" (FIG. 9A) in which one or more of the OEM heads of the machines are removed and retrofitted as set forth herein with the multi-flavor head. Moreover, the multi-flavor heads as set forth herein and the machines may be either adapted for dispensing multiple carbonated beverages (soda water) or comprise non-carbonated heads, for example, dispensing a multiplicity of juices therefrom.

FIG. 9 illustrates a multi-head post-mix beverage dispensing machine as seen in the prior art, the multi-head post-mix beverage dispensing machine comprising a multiplicity of single flavor dispensing heads. Each is adapted to receive from a backblock a syrup and a water, and provide a primary circuit comprising a flow controlled syrup pathway and a diluent (typically soda water) circuit pathway to a post-mix nozzle. Typically, these single flavor heads are lever actuated, when the user holds a cup against the lever.

FIG. 9A illustrates that at least one multi-flavor head as disclosed herein is provided with the valve disclosed herein adapted to carry the primary circuits from a backblock, typically an existing backblock from which the single flavor head has been removed. Applicant provides a supplemental circuit having multiple flow controlled syrup pathways and a manual, pushbutton controlled (as opposed to lever) actuator for selecting one of a multiplicity of syrups for dispensing from a post-mix valve engaged therewith. Typically, Applicant's multi-flavor valve has poppet valves engaged therewith and the new or retrofitted multi-flavor head is dimensioned, especially in width and height, from an outward appearance to be similar to the single flavor heads. In one embodiment, the lever actuated single flavor heads are for carbonated beverages, such as Coca-Cola, Pepsi Cola, Dr. Pepper, and the like. In this embodiment, Applicant's multi-flavor head may receive syrup in the form of juice flavors, such as apple, grape, etc. In such a case, on of Applicant's primary circuit pathways will receive non-carbonated water.

Although the invention has been described in connection with the preferred embodiment, it is not intended to limit the invention's particular form set forth, but on the contrary, it is intended to cover such alterations, modifications, and equivalences that may be included in the spirit and scope of the invention as defined by the appended claims.

The invention claimed is:

1. For retrofitting to an existing backblock of an existing single flavor head of a multi-head beverage dispensing machine, a multi-flavor head comprising:

a valve comprising:

walls adapted to fluidly engage the backblock;

a primary circuit comprising a pair of circuit pathways, including a syrup pathway, adapted to receive pressurized syrup and a water pathway adapted to receive pressurized water from the backblock;

a multiplicity of supplemental syrup pathways to carry a multiplicity of different syrups from a multiplicity of pressurized syrup sources;

flow control elements engaging each of the circuits to control the rate of flow of fluid therethrough;

a multiplicity of button controlled poppet valve chambers for opening and closing a multiplicity of circuits, such that a selected syrup pathway and the water pathway open simultaneously; and a post-mix nozzle assembly engaging the valve for mixing a syrup of the selected syrup pathway with the pressurized water from the primary circuit for dispensing into a container.

2. The multi-flavor head of claim 1, further including a housing to engage the valve.

3. The multi-flavor head of claim 2, wherein the valve has no electrical components.

4. The multi-flavor head of claim 3, wherein the valve has a button assembly on a front face thereof, for cooperation with the valved chambers.

5. The multi-flavor head of claim 4, wherein the button assembly has a membrane cover.

6. The multi-flavor head of claim 4, wherein the valve has a poppet valve portion including the valved chambers and a flow control portion, including the flow control elements, the poppet valve portion and the flow control portion removably and fluidly coupled one to the other.

7. The multi-flavor head of claim 1, further including supplemental syrup on/off valves upstream of the valved chambers for selectively allowing or preventing flow of syrup in the supplemental syrup pathways.

8. The multi-flavor head of claim 1, further comprising, separate from and upstream of the valve, self-adjusting flow control elements.

* * * * *

UNITED STATES PATENT AND TRADEMARK OFFICE

CERTIFICATE OF CORRECTION

PATENT NO. : 9,085,451 B2
APPLICATION NO. : 13/836171
DATED : July 21, 2015
INVENTOR(S) : David Santy et al.

It is certified that error appears in the above-identified patent and that said Letters Patent is hereby corrected as shown below:

On the title page, item 72

In the list of inventors, please add the following: -- Deborah A. Absalon, Converse, TX --.

Signed and Sealed this
Ninth Day of February, 2016

Michelle K. Lee

Michelle K. Lee
*Director of the United States Patent and Trademark Office*